US007757877B1

(12) United States Patent
Zimmer

(10) Patent No.: US 7,757,877 B1
(45) Date of Patent: Jul. 20, 2010

(54) BARREL JACKET

(76) Inventor: John C. Zimmer, 4308 W. Admiral Doyle Dr., New Iberia, LA (US) 70560

( * ) Notice: Subject to any disclaimer, the term of this patent is extended or adjusted under 35 U.S.C. 154(b) by 1008 days.

(21) Appl. No.: 11/047,916

(22) Filed: Feb. 1, 2005

(51) Int. Cl.
*B65D 21/02* (2006.01)

(52) U.S. Cl. ..... 220/23.87

(58) Field of Classification Search ..... 220/23.83, 220/23.86, 23.89, 23.91, 4.01, 1.5, 660; 294/68.3
See application file for complete search history.

(56) References Cited

U.S. PATENT DOCUMENTS 1,157,008 A * 10/1915 Lang ..... 220/6
1,922,605 A * 8/1933 Spear ..... 206/510
2,065,006 A * 12/1936 Zivanov ..... 220/592.14
2,452,195 A * 10/1948 Johnson ..... 215/12.1
3,063,591 A * 11/1962 Laginestra ..... 220/4.22
3,231,126 A * 1/1966 Cotney ..... 248/147
3,358,118 A * 12/1967 Mather et al. ..... 392/458
4,535,822 A * 8/1985 Rogers, Jr. ..... 138/99
4,972,950 A * 11/1990 Shillington ..... 206/366
5,011,026 A * 4/1991 Hausman et al. ..... 209/675
6,471,067 B1 * 10/2002 Lancaster ..... 206/594

* cited by examiner

*Primary Examiner*—Stephen Castellano
(74) *Attorney, Agent, or Firm*—Jones, Walker, Waechter, Poitevent, Carrere & Denegre, L.L.P.

(57) ABSTRACT

The invention is a barrel jacket designed to protect a barrel in transit. The invention is a container with at least one wall and a floor portion forming an interior, where the wall has an opening sized to allow a barrel to be placed in the interior of the container. The container wall includes a door section allowing access to the interior and closeable. The invention includes a series of offset plates positioned in the interior of the container, where the offset plates are positioned to engage a barrel placed in the interior of the container. Each of the offset plates is connected to but offset from the interior facing portion of the container's interior walls through a crushable member that is adapted to absorb energy caused by an impact to the exterior facing surface of the container's wall.

16 Claims, 11 Drawing Sheets

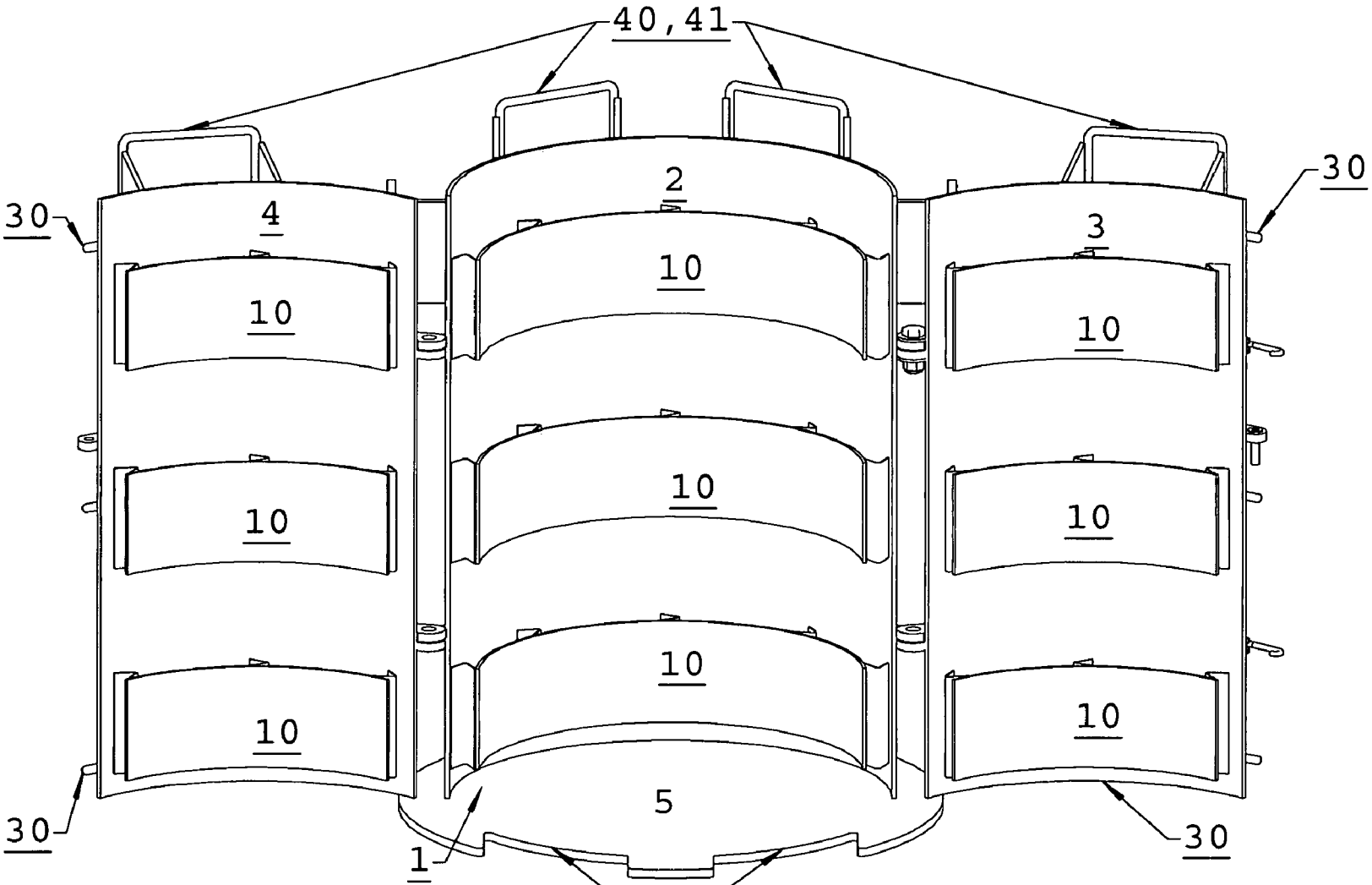
Fig. #1

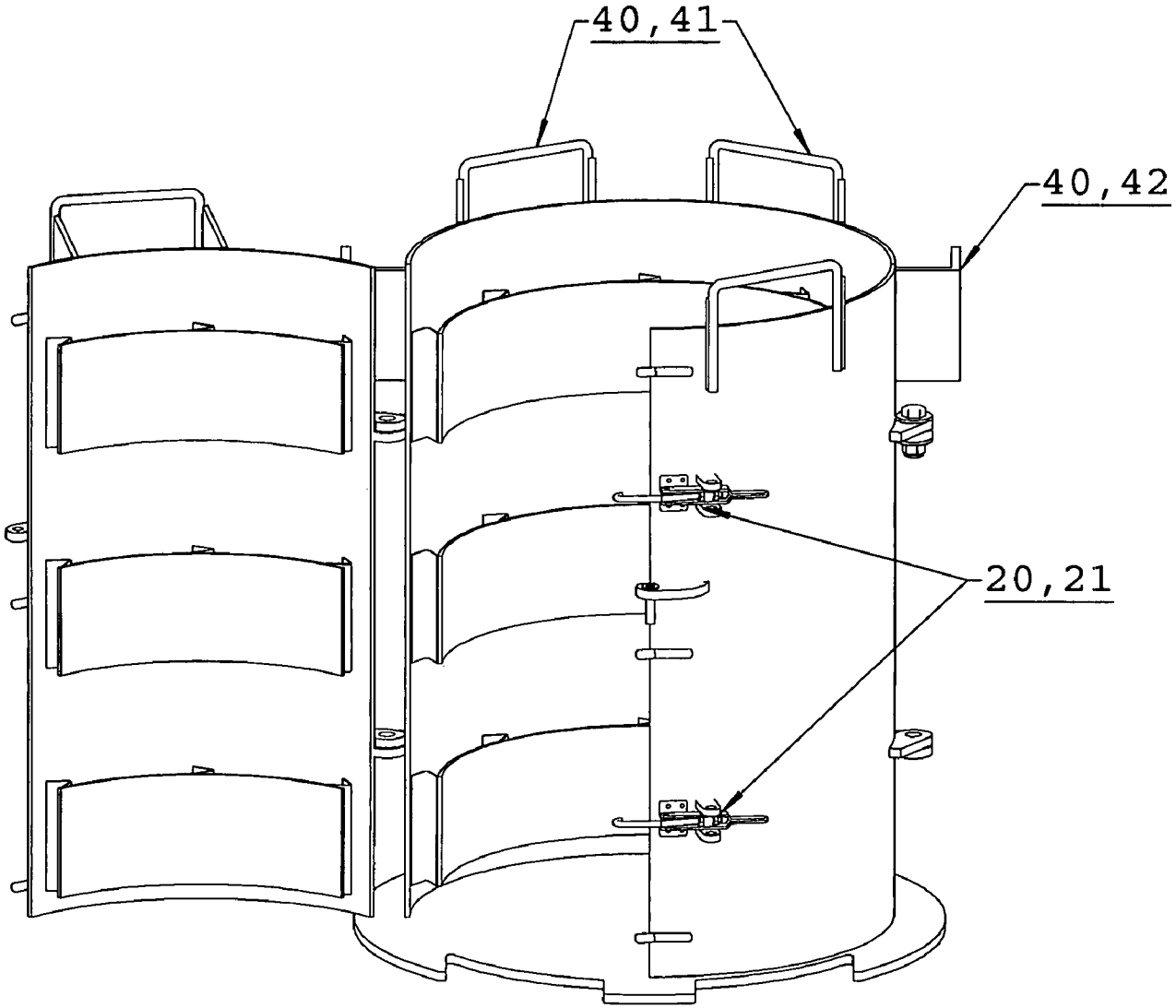
Fig. #2

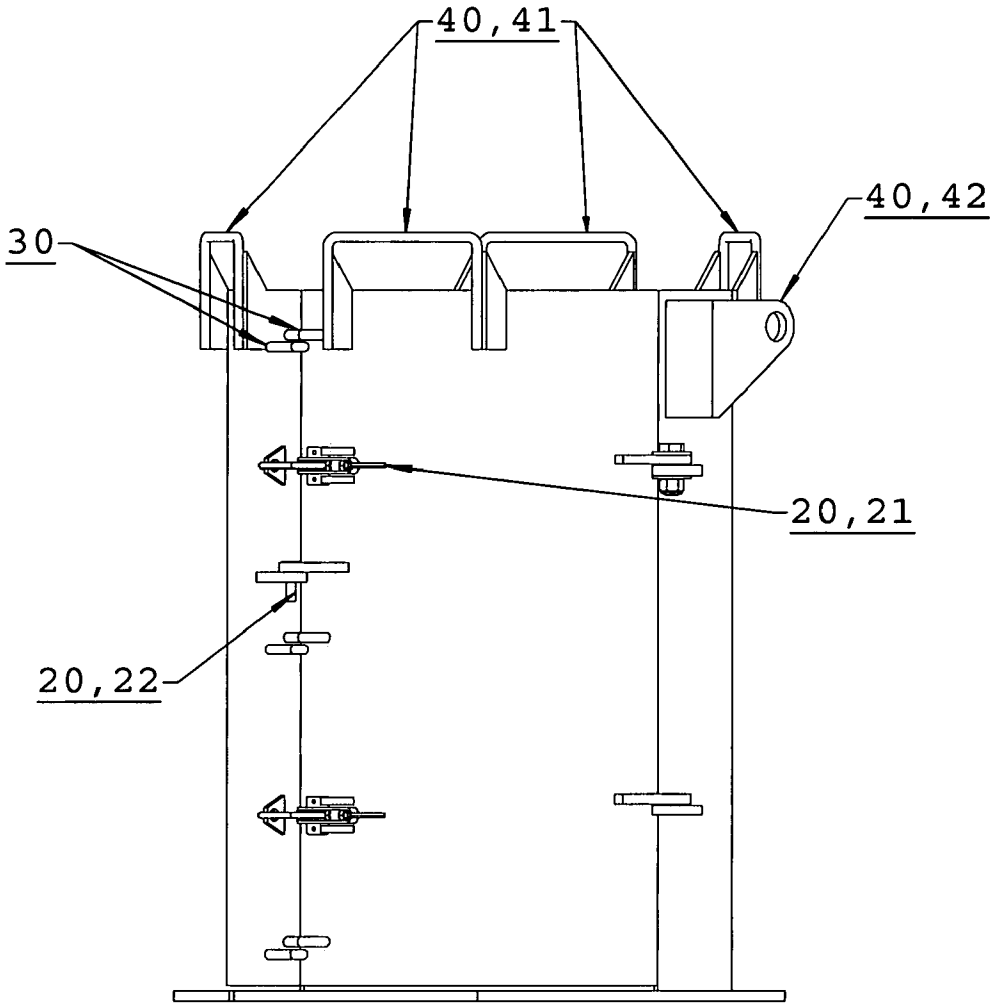
Fig. #3

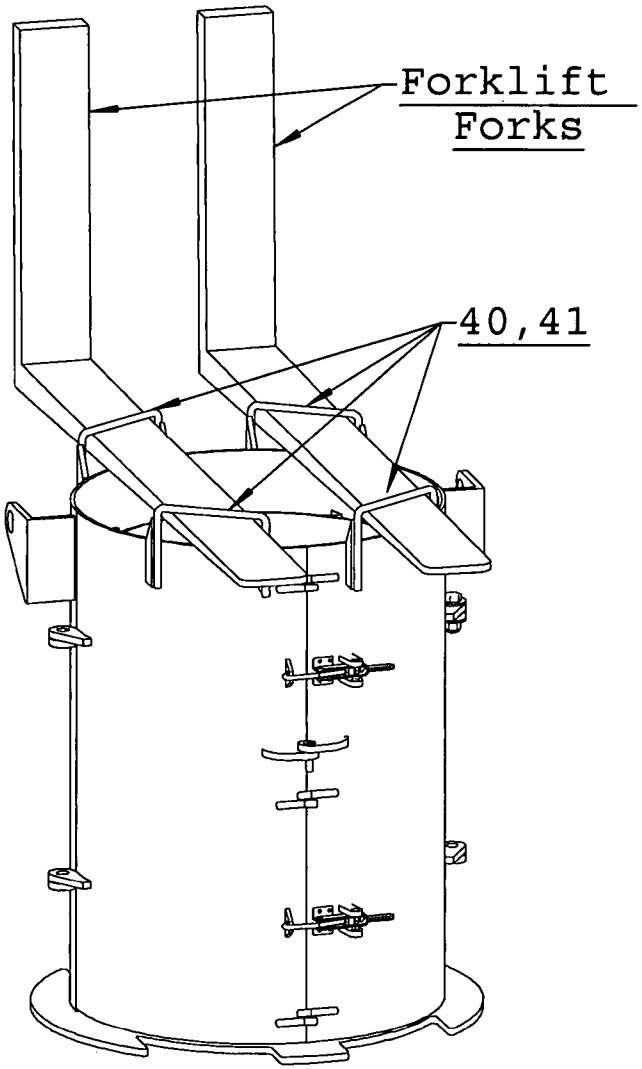
Fig. #4

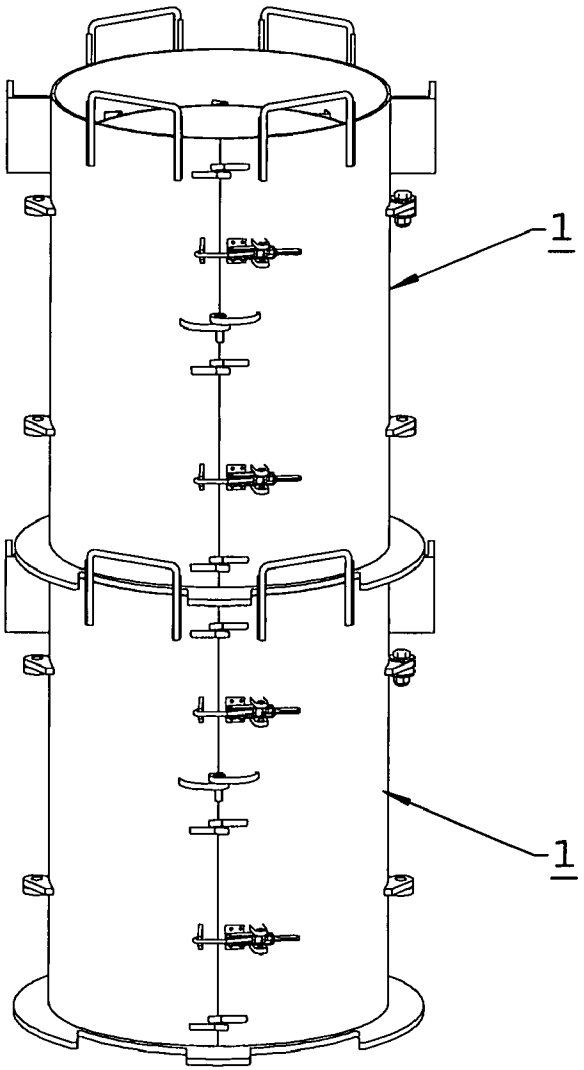
Fig. #5

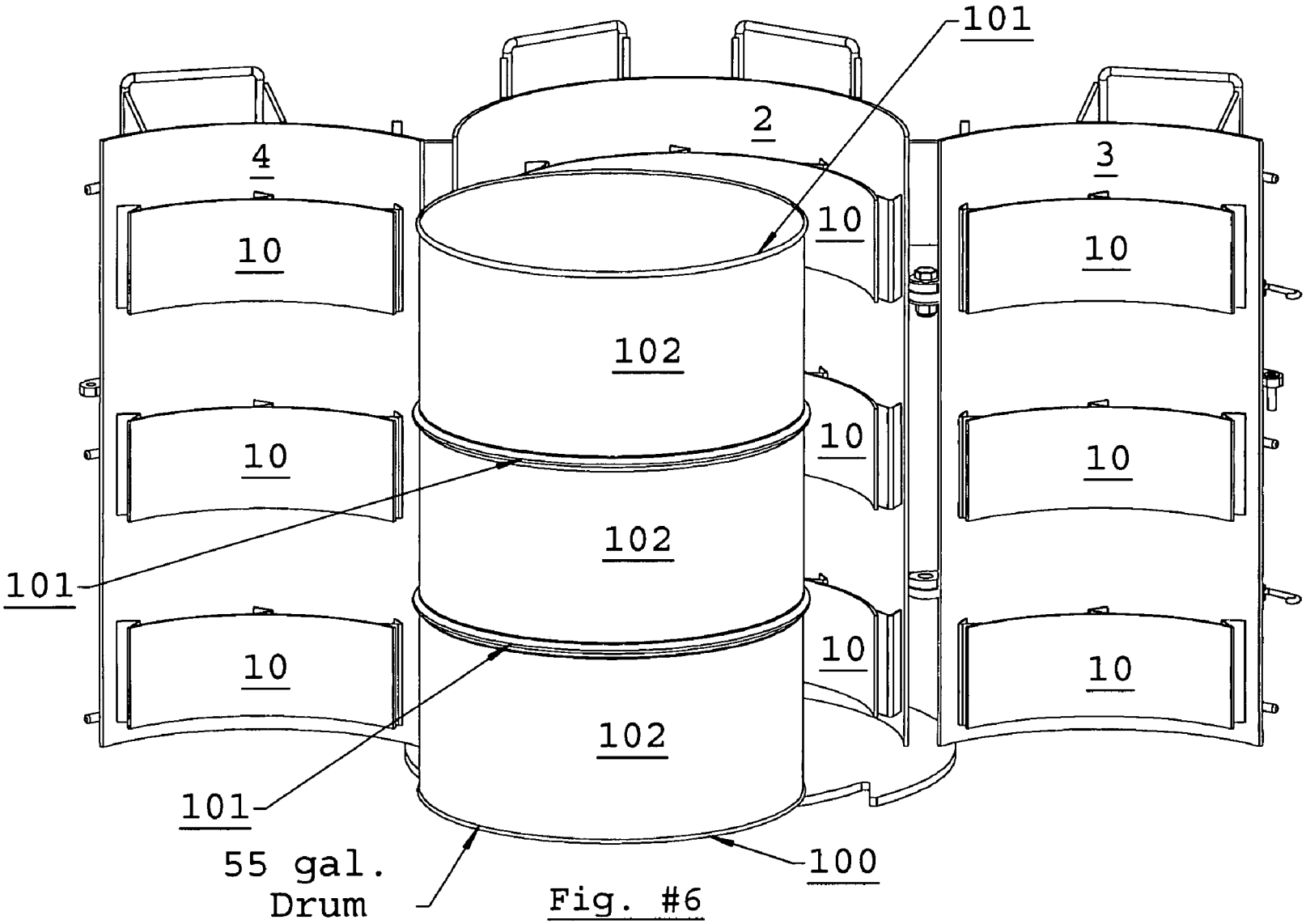
Fig. #6

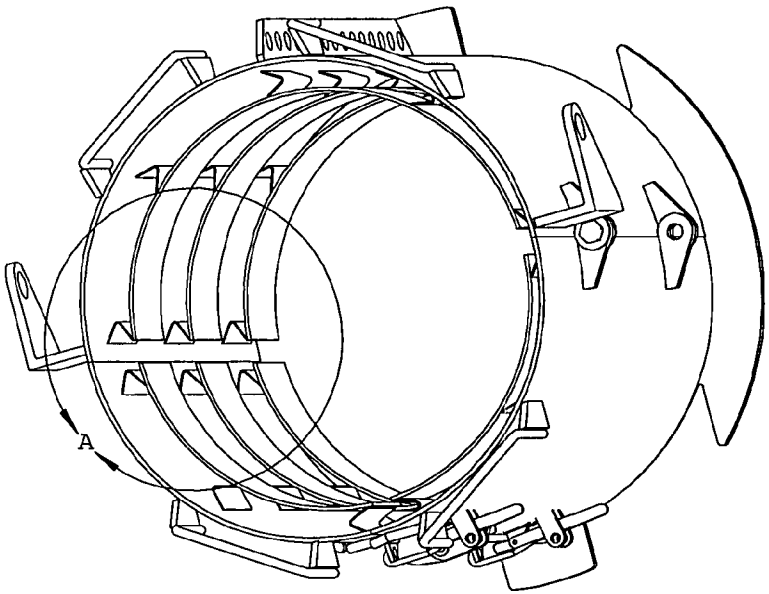
Fig. #7
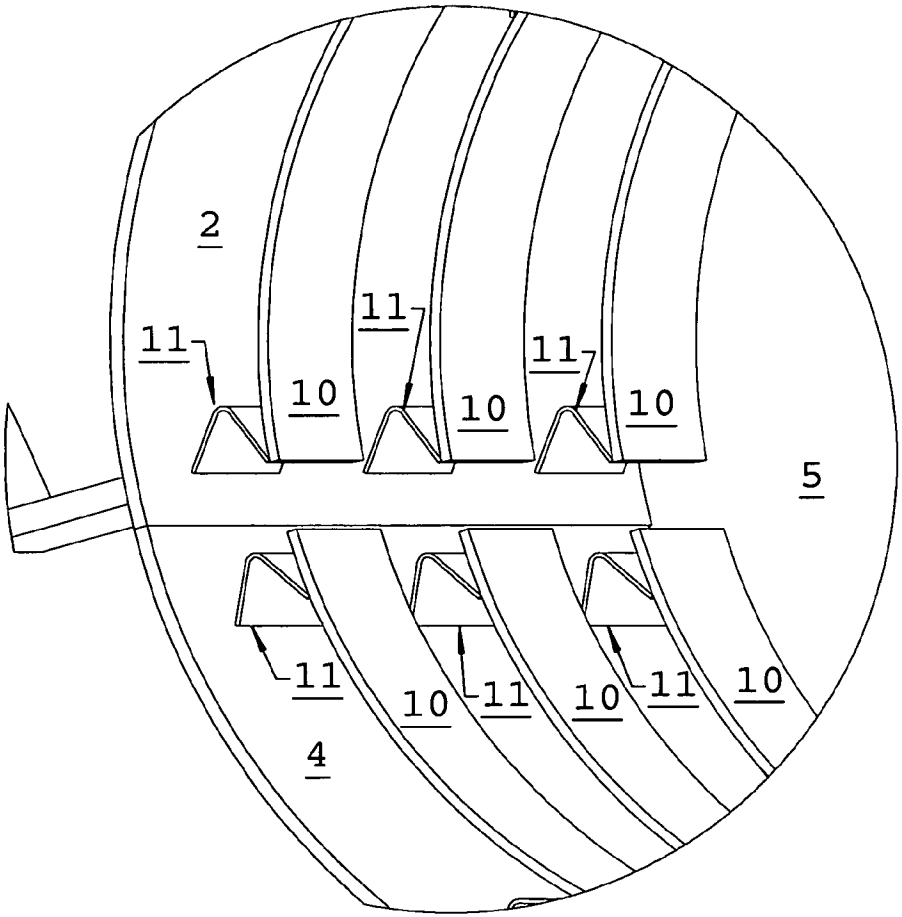
DETAIL A
SCALE 1 : 2

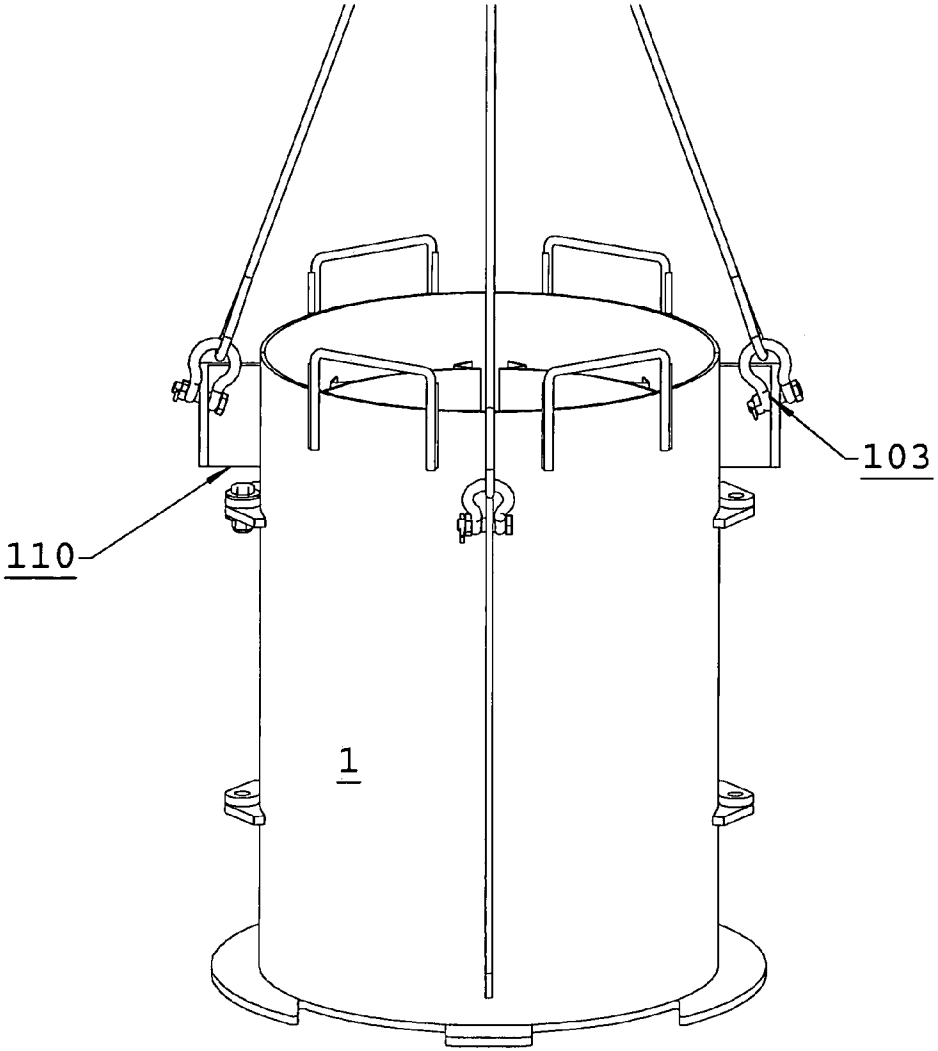
Fig. #9-A

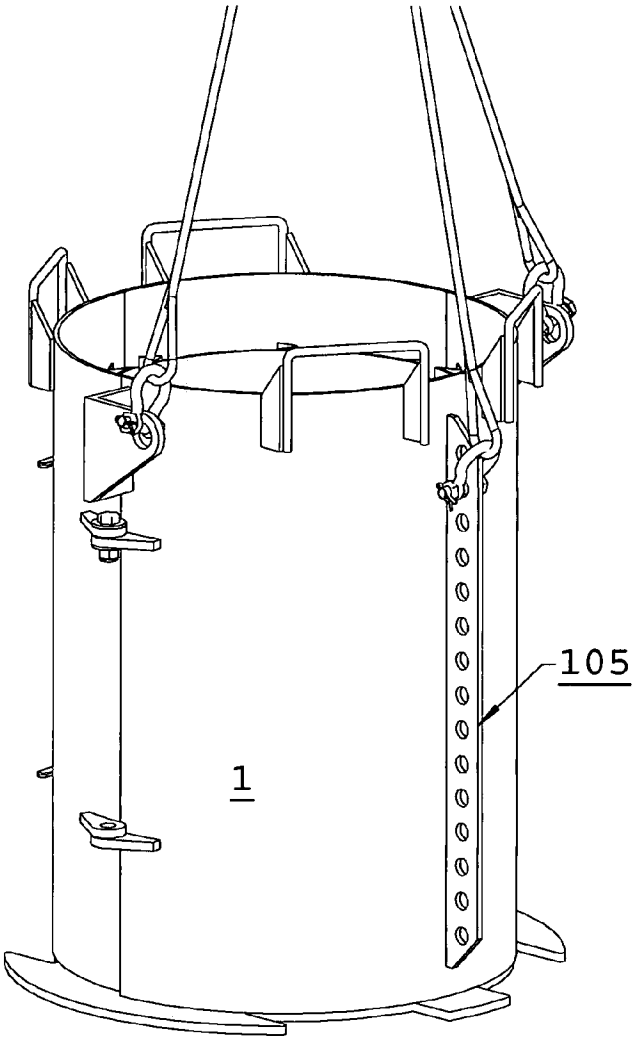
Fig. #9-B

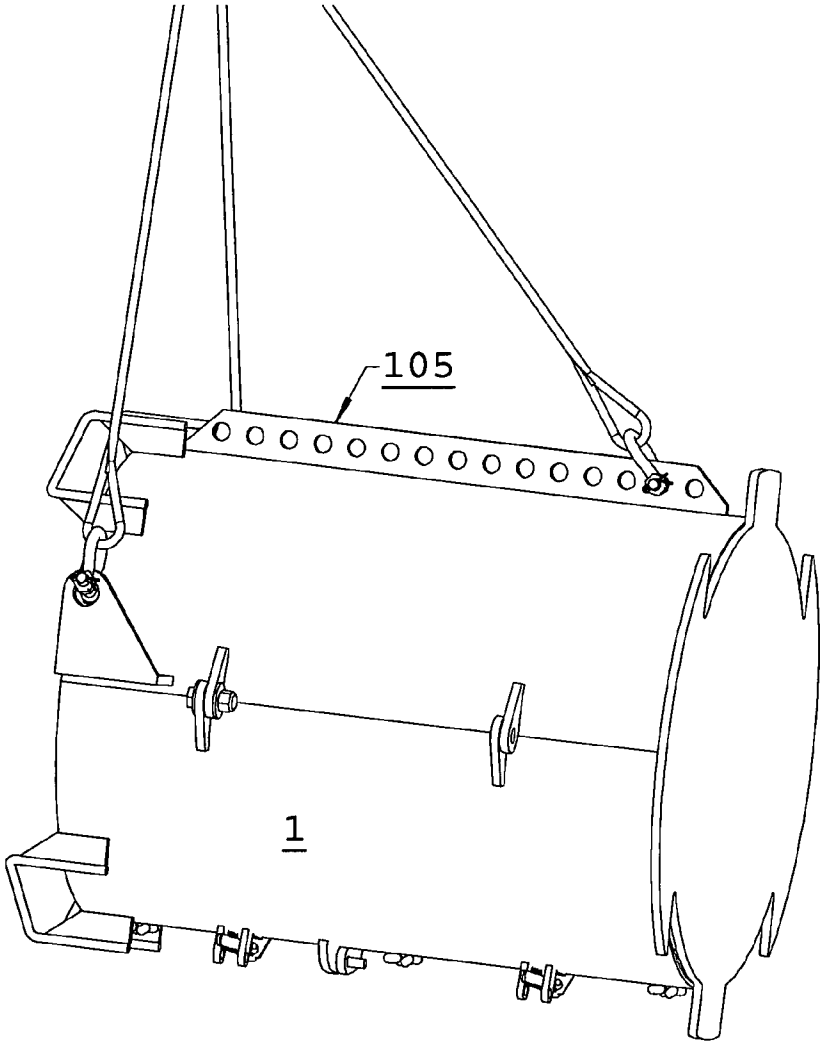
Fig. #9-C

BARREL JACKET

FIELD OF THE INVENTION

This invention relates to devices for lifting drums or barrels or other devices.

BACKGROUND OF INVENTION

Many liquid materials are transported in 55 gallon barrels, drum containers or other large volume containers (collectively, "barrels"). Barrels generally are moved in bulk by placing the barrels on a pallet to allow a forklift to move the loaded pallet. Movement of individual barrels is problematic, as individual barrels (generally cylindrically shaped) have no ready "handles" or other lifting assistance mechanism to which a fork lift or other lifting device can grasp for ease of movement. Individual barrels may be sling lifted by crane, but sling lifting presents problems. The sling lifted barrel may sway when lifted which can result in the barrel striking surrounding objects or structures. This can be particularly troublesome if the barrel contains hazardous materials, as a resulting spill can cause severe injury or result in contamination problems.

OBJECTS OF THE INVENTION

It is an object of the invention to provide a protective jacket to protect a barrel during transportation.

It is an object of the invention to provide a lifting jacket to allow a barrel to be easily and safely moved during transportation.

It is an object of the invention to supply a jacket having crushable plates to protect a barrel from impact with other objects.

SUMMARY OF THE INVENTION

The invention is a jacket designed to generally surround a barrel. The interior of the jacket has a series of offset plates joined to the interior through crushable plates. The offset plates generally contact the barrel to protect the barrel in the event of an impact. The jacket has lifting structures positioned on the jacket to assist the ease of transportation of the jacketed barrel.

BRIEF DESCRIPTION OF THE DRAWINGS

FIG. 1 depicts one embodiment of an open barrel jacket.

FIG. 2 depicts the embodiment of FIG. 1 in a partially closed position.

FIG. 3 depicts the top portion of the jacket shown in FIG. 1.

FIG. 4 depicts the top portion of the jacket of FIG. 3 being raised by a fork lift.

FIG. 5 depicts tow jackets stacked vertically.

FIG. 6 depicts the barrel jacket of FIG. 1 with a barrel to be stored in the jacket.

FIG. 7 depicts the interior of the barrel jacket detailing the offset and crushable plates.

FIG. 9A depicts the barrel jacket with attached horizontal lifting brackets.

FIG. 9B depicts the barrel jacket with attached horizontal lifting bar.

FIG. 9C depicts the barrel jacket with attached horizontal lifting bar of FIG. 9B and lift brackets of FIG. 9A lifted in a horizontal orientation.

DETAILED DESCRIPTION OF THE PREFERRED EMBODIMENT

Figure 8:
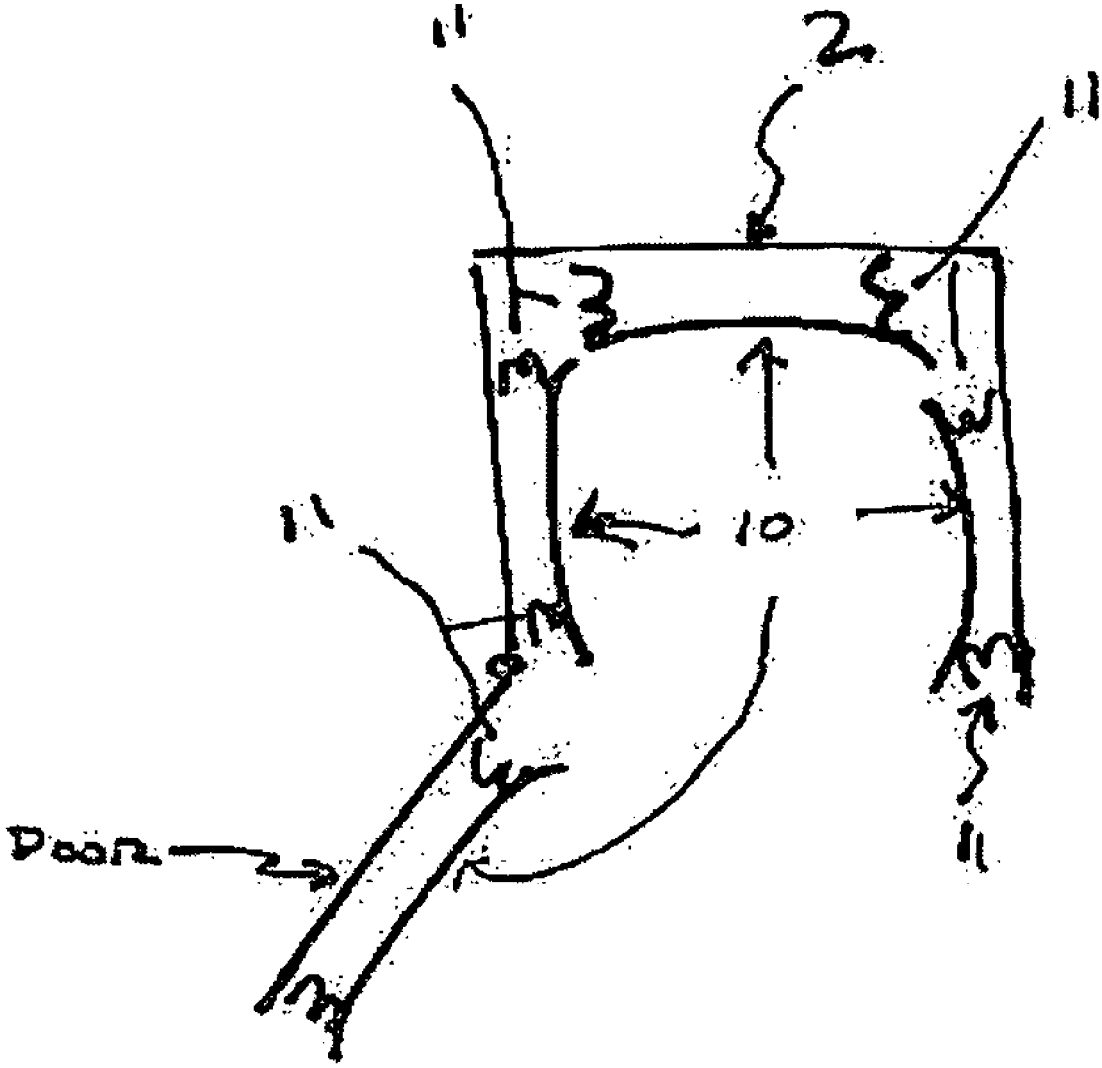
FIG. 8 is a horizontal cross-section through a square shaped barrel jacket.

Shown in FIG. 1 is the barrel jacket 1. In the embodiment of FIG. 1, barrel jacket 1 is a cylindrical container comprising a fixed back wall 2, doors 3 and 4, and bottom plate 5. As shown, fixed back wall 2 comprises about half of the outer wall of the container, while the doors 3 and 4 comprising the remaining portion of the container walls. As shown, doors 3 and 4 are hinged to the back wall and when closed form an interior. Instead of a hinged door, a single "door" (a curved plate) could be used that is attachable to the remaining structure to form an interior when attached. For instance, a single curved plate could be positioned in the opening and banded or clamped in place, or bolted in place through flange plates, thereby closing the opening forming an interior. In the preferred embodiment shown in FIG. 1, the door opening is large enough to allow a barrel to be easily rolled into the interior. The preferred barrel jacket 1 uses two doors 3 and 4 instead of a single door to reduce the space or footprint required to swing a single door. When closed, the device 1 creates an enclosure sized to accommodate a barrel. As shown, the jacket walls 2, 3 and 4 create a solid enclosure, but the enclosure could have openings, either vertical open bands or horizontal open bands, to help reduce the weight of the overall device 1.

As shown in FIGS. 2 and 3, positioned on the exterior of the doors 3 and 4 are locking means 20 to allow the doors to be closed and fixed or locked in the closed position. A preferred locking means 20 is an adjustable pull action type clamp 21, manufactured by Destaco Industries, Inc. As shown in FIG. 3, two clamps 21 are preferred. The adjustable type clamp 21 allows the doors 3 and 4 to be locked in a variety of positions to account for out-of-round or dented barrels. Other types of clamps and adjustable type clamps could be utilized. Additionally, shown in FIG. 3 is a locking pin 22, which allows the doors 3 and 4 to be pinned together through flanges in each exterior door wall. The locking pin 22 and flanges are also considered a locking means 20, and may be used without a clamp 21, but this arrangement is not preferred. Finally, positioned on the top and bottom of the doors 3 and 4 are protruding stubs 30, shown in FIGS. 1 and 3. These stubs 30 reduce racking strains on the doors 3 and 4 that may appear during movement of a "loaded" barrel jacket 1.

Fixed back wall 2 is attached to the bottom plate 5, such as by welding or bolting through a flange plate. The top of the jacket 1 is opened, but could be closed with an attachable top if desired. As shown, bottom plate 5 is flat, not raised. While this allows for ease of rolling a barrel into the interior of the device 1, it eliminates the possibility to pick-up a barrel jacket 1 from underneath the device, such as with a fork-lift. To allow the device 1 to be moved, lifting means 40 are used. One such lifting means 40 is raised handles 41 sized to accommodate a fork lift's blade that are positioned on, and extending above, the top of the barrel jacket 1. As shown, four handles 41 are employed. Two handles 41 could be used, but such is not preferred, as the lifted device 1 could rock about the lifted points. A barrel jacket 1 raised via fork lift is shown in FIG. 4. Other lifting means 40 can be used with the device. Shown in FIG. 5 are two eyelets 42 positioned on opposite sides of the jacket's wall. Eyelets 42 allow for secure attachment of a sling lifting harness for crane lifting of the barrel jacket 1 upwardly.

It is desired that barrel jackets 1 be vertically stackable. To assist in stacking, the bottom plate 5 is slightly larger than the outer wall's (2, 3 and 4) footprint. However, to allow barrel jackets 1 to be stacked when handles 41 are incorporated in the device 1, cutouts 50 must be positioned in the bottom plate 5 to accommodate the raised handles 41 as is shown in FIG. 1. Stacked barrel jackets 1 are shown in FIG. 5.

Positioned on the interior walls of the jacket 1 are a series of offset plates 10, as shown in FIG. 6. As shown, offset plates 10 are plates shaped to follow a portion of the outer surface of a barrel 100 when placed in the interior of the jacket 1. In the present case, the offset plates 10, in horizontal cross-section, are sections of a circle. Each offset plate 10 is connected to the interior wall of the barrel jacket 1 in an offset position by a crushable means. As shown in FIG. 6, crushable means are a series of crumple plates 11, and in this embodiment, the offset distance is about 1-3 inches. The crushable means, such as the crumple plates 11, are designed to absorb energy caused by an impact or strike to the outer surface of the barrel jacket 1 to reduce energy transmission (and resultant damage) to a barrel 100 positioned in the interior of the barrel jacket 1. In the case of crumple plates, energy absorption is effected by a bending or crumpling of the crumple plates 11. For other deformable materials, energy absorption is accomplished in the process of deformation.

As shown, crumple plates 11 are "u" shaped or triangular shaped metal plates that join the offset plates 10 to the interior wall of the barrel jacket 1 along a vertical line. Crumple plates 11 can be other shapes, such as accordion or wave shaped or other energy adsorbing shapes. The crushable means could also be crushable rigid foam, fluid bladders, or other deformable materials. The crumple plates 11 are joined to the offset plates 10 and the interior of the jacket walls 1 by welding, but other means of joining can also be used. A single accordion style crumple plate could be used along the length of an offset plate, or at least two separate crumple plates 11 (one at each end of the offset plate), could be used for each offset plate 10 (at the two ends), for longer offset plates, more that two separate crumple plates 11 per offset plate 10 may be preferred. It is preferred that the crumple plates 11 be smaller gauge or thinner thickness material than the outer wall of the jacket 1 and the offset plates 10 to assist in energy adsorption. In one embodiment, the outer wall and offset plates 10 are formed from quarter to half inch thick steel, while the crumple plates are formed from 16 gauge steel.

One type of gallon barrel 100 (a 55 gallon drum) is shown in FIG. 3. This barrel 100 has four protruding horizontal ribs 101: a top rib, bottom rib, and two middle ribs. These four ribs 101 create three slightly depressed vertical areas 102 therebetween on the barrel's outer sidewall surface. A barrel jacket 1 designed to accommodate this type of barrel 100 is shown in FIG. 6. The jacket 1 is shown opened and as can be seen, there are three horizontal bands of offset plates 10 designed to align with the three depressed sidewall barrel regions 102. Each band comprises three crumple plates, one on each door 3 and 4 and one on the back fixed wall 1. As shown, each of the three bands substantially (but not continuously) encircles the interior of the jacket 1 when the jacket doors 3 and 4 are closed. For this type of barrel 100, three bands are preferred, but a single band or double band of offset plates 10 and associated crumple plates 11 can be used. Additionally, it is not necessary that each band substantially encircle the interior of the jacket. For instance, short segment offset plates 10 (such as 6-8 inches in length) could be placed around the circumference of the interior wall, at for instance 120 degrees apart or 90 degrees apart, or other suitable spacing. The desired effect is that when the barrel jacket 1 is closed, the barrel 100 in the interior of the jacket 1 is supported by the offset plates 10. For this reason, the shape of the offset plates 10 should mimic or follow the shape of that portion of the barrel 100 it contacts. However, it is not necessary that the shape of the exterior of the barrel jacket 1 mimic that of the barrel. For instance, the barrel jacket 1 could be octagonal or square shaped, with circular shaped offset plates 10 positioned on the interior walls, as is shown in the cross section of FIG. 8 for a square shaped outer jacket.

It may be desired to lift the enclosed barrel and position the lifted barrel horizontally or at an angle with respect to the horizontal to assist in emptying the barrel (see FIG. 9C). The jacket 1 may have attached horizontal lift brackets 110, positioned on the exterior of the jacket 1. Shown in FIG. 9A are two horizontal lift brackets 110 offset horizontally from one another on the exterior of the jacket and positioned about 180 degrees apart near the top portion of the barrel jacket 1. As shown in FIG. 9A, the horizontal lift brackets are eyelets attached to the exterior of the jacket where the eyelets are positioned on a flange member 103 to offset the "eye" or opening of the lift bracket 110 from the exterior shell of the barrel jacket 1 for ease of shackle attachment.

Shown in FIG. 9B is another type of lift bracket, a lift bar 105. As shown, lift bar 105 is a plate member positioned between lift brackets 110 and running vertically down the barrel jacket. Lift bar 105 has a series slots or openings 106 positioned therethrough. When a three point sling is attached via shackles through the horizontal lifting brackets 110 and lift bar 105, the lifted barrel jacket will tend to tilt from the vertical plane, and the degree of "tilt" will depend upon the attachment point on the lift bar 105. Attaching a sling near the bottom of the lift bar 105 will orient the lifted barrel jacket substantially horizontally, as shown in FIG. 9C. If the barrel bung has been replaced with a valve or spigot, a lifted barrel can be emptied by operation of the valve or spigot. If desired, lift bar 105 may be replaced with one or a series of eyelets positioned vertically on the exterior wall of the barrel jacket. Additionally, using a two point sling attached only to slots on the lift bar 105, the jacket can also be lifted to a horizontal position. However, using the lift bar 105 alone as the sole means of lifting horizontally is not preferred, as the lifted device is harder to control than when a three point sling or harness is used for lifting as shown in FIG. 9C.

Other embodiments of the invention will occur to those skilled in the art, and are intended to be included within the scope and spirit of the following claims.

I claim:

1. A barrel jacket comprising a container having at least one wall and a floor portion forming an interior, said at least one wall having an opening therein adapted to accommodate a barrel having a sidewall, said at least one wall further having a door section, said door section allowing access to the interior of said barrel jacket and said door section adapted to close said opening to retain a barrel positioned in said interior, said barrel jacket having a series of offset plates positioned in the interior of said container, said offset plates positioned to engage a barrel's sidewall when located in said interior of said container, each of said offset plates being connected to but offset from the interior facing portion of said wall through a crushable means to absorb energy caused by an impact to the exterior facing surface of said wall, said crushable means to absorb energy being interposed between but fixedly joined to said interior wall and to said offset plates.

2. The barrel jacket of claim 1 wherein said crushable means comprises a crumple plate.

3. The barrel jacket of claim 2 wherein said crumple plate comprises a "u" or "v" shaped plate positioned between said at least one said wall and said offset plate.

4. The barrel jacket of claim 1 further having a lifting means positioned on said barrel jacket.

5. The barrel jacket of claim 4 wherein said lifting means comprises a series of handles protruding above the top of said at least one wall and adapted to accept the forks of a fork lift.

6. The barrel jacket of claim 4 wherein said lifting means comprises a series of eyelets positioned on the exterior facing surface of said at least one wall.

7. The barrel jacket of claim 1 further having a locking means to retain said door section in a closed position.

8. The barrel jacket of claim 7 wherein said locking means comprises an adjustable clamp.

9. The barrel jacket of claim 7 wherein said locking means comprises is a band adapted to retain said door section in a closed position.

10. The barrel jacket of claim 7 wherein said at least one wall has opposing flanges adapted positioned on said exterior facing surface, one of said opposing flanges positioned on said door section, and a pin adapted to connect said opposing flanges.

11. The barrel jacket according to claim 1 wherein said floor portion is adapted to allow two barrel jackets to be stacked vertically.

12. The barrel jacket of claim 11 wherein said adaptation comprises said floor portion extending partially outside the exterior facing perimeter of said at least one wall.

13. The barrel jacket of claim 1 wherein said at least one wall forms a cylinder.

14. The barrel jacket of claim 1 wherein said offset plates are positioned on the interior of said at least one wall in at least one horizontal band.

15. The barrel jacket of claim 1 having an exterior surface, and at least one horizontal lift bracket positioned on said exterior surface, said lift bracket adapted to accept a shackle.

16. The barrel jacket of claim 15 wherein said horizontal lift bracket comprises a bar mounted substantially vertically on said exterior surface, said bar having a series of vertically offset openings positioned therethrough.

* * * * *